US008196618B2

(12) United States Patent
Kim et al.

(10) Patent No.: US 8,196,618 B2
(45) Date of Patent: Jun. 12, 2012

(54) DISPENSER WITH AN ICE DISCHARGE DUCT IN WHICH A PART OF THE ICE DISCHARGE DUCT IS DETACHABLY PROVIDED AND A REFRIGERATOR INCLUDING THE SAME

(75) Inventors: Seong Jae Kim, Seoul (KR); Nam Gi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1013 days.

(21) Appl. No.: 12/167,334

(22) Filed: Jul. 3, 2008

(65) Prior Publication Data

US 2009/0008404 A1 Jan. 8, 2009

(30) Foreign Application Priority Data

Jul. 4, 2007 (KR) ..... 10-2007-0067005

(51) Int. Cl.
*B65B 3/04* (2006.01)
*B65B 1/04* (2006.01)

(52) U.S. Cl. ..... 141/82; 141/104; 141/291; 141/360; 62/3.63; 62/3.64; 62/382; 62/389

(58) Field of Classification Search ..... 141/82, 141/104, 291, 351, 360; 222/146.6; 62/3.63, 62/3.64, 382, 389
See application file for complete search history.

(56) References Cited

U.S. PATENT DOCUMENTS 3,094,154 A 6/1963 Daniels
3,640,088 A * 2/1972 Jacobus et al. ..... 62/320
3,747,363 A * 7/1973 Grimm ..... 62/377
4,069,545 A * 1/1978 Holet et al. ..... 141/362
4,227,383 A * 10/1980 Horvay ..... 62/344
4,285,212 A * 8/1981 Prada ..... 141/358
4,462,437 A * 7/1984 Prada ..... 141/360
5,474,213 A * 12/1995 Unger ..... 141/86
5,526,854 A * 6/1996 Unger ..... 141/351

(Continued)

FOREIGN PATENT DOCUMENTS

DE 2128229 12/1971

OTHER PUBLICATIONS

International Search Report issued in Application No. PCT/KR2008/003942, mailed Oct. 13, 2009, 4 pages.

*Primary Examiner* — Gregory Huson
*Assistant Examiner* — Nicolas A Arnett
(74) *Attorney, Agent, or Firm* — Fish & Richardson P.C.

(57) ABSTRACT

A dispenser and a refrigerator including the same are disclosed. The dispenser includes a first section of ice discharge duct that receives ice supplied from an ice supplier, a second section of ice discharge duct that receives the ice guided by the first section, and a third section of ice discharge duct that receives the ice guided by the second section. The third section guides the ice through an outlet positioned in front of a surface of a door of the refrigerator. The dispenser also includes a first coupling mechanism located at the second section and a second coupling mechanism located at the third section. The first and second coupling mechanisms are configured to engage and disengage with each other to enable removal of the third section from the second section and attachment of the third section to the second section.

24 Claims, 12 Drawing Sheets

U.S. PATENT DOCUMENTS 5,542,265 A * 8/1996 Rutland ..... 62/389
5,829,646 A 11/1998 Schroeder et al.
7,007,500 B2 * 3/2006 Lee ..... 62/389
7,017,363 B2 * 3/2006 Lee et al. ..... 62/320
7,963,120 B2 * 6/2011 An et al. ..... 62/344
7,997,452 B2 * 8/2011 Kim et al. ..... 222/146.6
8,001,796 B2 * 8/2011 Kim et al. ..... 62/390
8,006,502 B2 * 8/2011 Kim et al. ..... 62/389
2003/0230108 A1 12/2003 Lucas et al.

* cited by examiner

DISPENSER WITH AN ICE DISCHARGE DUCT IN WHICH A PART OF THE ICE DISCHARGE DUCT IS DETACHABLY PROVIDED AND A REFRIGERATOR INCLUDING THE SAME

CROSS REFERENCE TO RELATED APPLICATIONS

This application claims the benefit of Korean Patent Application No. 10-2007-0067005, filed on Jul. 4, 2007, which is hereby incorporated by reference as if fully set forth herein.

FIELD

The present disclosure relates to dispenser technology.

BACKGROUND

A dispenser may be mounted to a refrigerator, to selectively supply, to a user, a certain content, such as ice made by an ice maker included in the refrigerator or liquid water cooled or heated by the refrigerator. An interior of a dispenser may be difficult for a user to clean because the interior of the dispenser may not be easily visible or accessible to the user.

SUMMARY

In one aspect, a refrigerator dispenser includes a first section of ice discharge duct that defines a first portion of an ice flow passage configured to receive ice supplied from an ice supplier and guide the ice. At least a portion of the first section of ice discharge duct is positioned behind a surface of a door of an refrigerator. The refrigerator dispenser also includes a second section of ice discharge duct that is configured to receive the ice guided by the first portion of the ice flow passage defined by the first section of ice discharge duct and further guide the ice along a second portion of the ice flow passage. At least a portion of the second section of ice discharge duct is positioned in front of the surface of the door of the refrigerator. The refrigerator dispenser further includes a third section of ice discharge duct that is configured to receive the ice guided by the second portion of the ice flow passage defined by the second section of ice discharge duct and further guide the ice along a third portion of the ice flow passage through an outlet of the third section of ice discharge duct that is positioned in front of the surface of the door of the refrigerator and configured to guide the ice to a position outside of the ice flow passage in front of the surface of the door of the refrigerator. The refrigerator dispenser includes a first coupling mechanism located at the second section of ice discharge duct and a second coupling mechanism located at the third section of ice discharge duct, the first and second coupling mechanisms being configured to engage and disengage with each other to enable removal of the third section of ice discharge duct from the second section of ice discharge duct and attachment of the third section of ice discharge duct to the second section of ice discharge duct.

Implementations may include one or more of the following features. For example, the dispenser may include a button and tray combination device that is configured to control the dispenser to dispense ice through the outlet of the third section of ice discharge duct and that is configured to receive and store residual content discharged from the outlet of the third section of ice discharge duct after a container used in actuating the button and tray combination device is moved from beneath the outlet of the third section of ice discharge duct. In another example, the dispenser may include a door handle provided below the outlet of the third section of ice discharge duct, and a tray secured to the door handle and positioned to receive ice dispensed from the outlet of the third section of ice discharge duct.

In some implementations, the first section of ice discharge duct may be embedded in a refrigerator door and the second section of ice discharge duct may be configured to move from a stored position in which an outlet of the second section of ice discharge duct is positioned behind a surface of the refrigerator door to an operable position in which the outlet of the second section of ice discharge duct is positioned in front of the surface of the refrigerator door. In these implementations, the dispenser may include a fixed guide that is attached to the first section of ice discharge duct, positioned within the first section of ice discharge duct, and configured to guide the content to the second section of ice discharge duct.

The second section of ice discharge duct may include a moving body rotatable or slidable with respect to the refrigerator door such that the moving body is configured move from a stored position in which a portion of the moving body is positioned behind the surface of the refrigerator door to an operable position in which the portion of the moving body is positioned in front of the surface of the refrigerator door, the moving body including a seat configured to receive the third section of ice discharge duct when the third section of ice discharge duct is attached to the second section of ice discharge duct. A discharger may be arranged between the fixed guide and the supplier. The discharger may include a member configured to open and close the discharger to selectively supply content from the supplier to the fixed guide.

In some examples, the first section of ice discharge duct may be embedded in a refrigerator door, the dispenser may define, in front of the surface of the refrigerator door, a dispensing area configured to receive a container, and the first section of ice discharge duct, the second section of ice discharge duct, and the third section of the ice discharge duct may be configured to guide content to the dispensing area. In these examples, the second section of ice discharge duct may include a seat configured to receive the third section of ice discharge duct when the third section of ice discharge duct is attached to the second section of ice discharge duct. In addition, a discharger may be arranged between the second section of ice discharge duct and the supplier. The discharger may include a member configured to open and close the discharger to selectively supply content from the supplier to the second section of ice discharge duct.

In some implementations, the second section of ice discharge duct may be coupled to a surface of the door of the refrigerator such that the second section of ice discharge duct is positioned outside of the surface of the door on a side opposite of a compartment opened and closed by the door. In these implementations, the second section of ice discharge duct may include a seat configured to receive the third section of ice discharge duct when the third section of ice discharge duct is attached to the second section of ice discharge duct.

The first coupling mechanism may include a slide groove, and the second coupling mechanism may include a slide fit that is configured to engage with the slide groove such that the slide fit slides along the slide groove. The slide fit may include a slide rail, and a hook provided at an end of the slide rail, and the slide groove may include a first groove configured to engage with the slide rail and an engagement groove provided at an end of the first groove and configured to engage with the hook.

The first coupling mechanism may include a female thread, and the second coupling mechanism may include a male thread configured to engage with the female thread to attach the third section of ice discharge duct to the second section of ice discharge duct. The first coupling mechanism also may include a swing groove configured to guide the third section of ice discharge duct along a spiral path of a predetermined angle, and the second coupling mechanism may include a swing protrusion configured to engage with the swing groove such that the swing protrusion rotates spirally along the spiral path. The swing groove comprises may include a spiral groove configured to receive the swing protrusion and guide the swing protrusion along the spiral path, and a stopper configured to engage with swing protrusion to attach the third section of ice discharge duct to the second section of ice discharge duct.

The dispenser may include a coupling protrusion provided at one of the second section of ice discharge duct and the door, and a coupling groove provided at the other of the second section of ice discharge duct and the door, the coupling groove being configured to engage with the coupling protrusion. The second section of ice discharge duct may be removable from and replaceable to the refrigerator door.

In another aspect, a refrigerator includes a refrigerator body defining a cooling compartment, a door configured to open and close at least a portion of the cooling compartment, and a first section of ice discharge duct that defines a first portion of an ice flow passage configured to receive ice supplied from an ice supplier and guide the ice. At least a portion of the first section of ice discharge duct is positioned behind a surface of the door. The refrigerator also includes a second section of ice discharge duct that is configured to receive the ice guided by the first portion of the ice flow passage defined by the first section of ice discharge duct and further guide the ice along a second portion of the ice flow passage. At least a portion of the second section of ice discharge duct is positioned in front of the surface of the door. The refrigerator further includes a third section of ice discharge duct that is configured to receive the ice guided by the second portion of the ice flow passage defined by the second section of ice discharge duct and further guide the ice along a third portion of the ice flow passage through an outlet of the third section of ice discharge duct that is positioned in front of the surface of the door and configured to guide the ice to a position outside of the ice flow passage in front of the surface of the door. The refrigerator includes a first coupling mechanism located at the second section of ice discharge duct and a second coupling mechanism located at the third section of ice discharge duct. The first and second coupling mechanisms are configured to engage and disengage with each other to enable removal of the third section of ice discharge duct from the second section of ice discharge duct and attachment of the third section of ice discharge duct to the second section of ice discharge duct. The refrigerator also includes a door handle provided below the outlet of the third section of ice discharge duct, and a tray secured to the door handle and positioned to receive ice dispensed from the outlet of the third section of ice discharge duct.

Implementations may include one or more of the following features. For example, the first coupling mechanism may include a slide groove, and the second coupling mechanism may include a slide fit that is configured to engage with the slide groove such that the slide fit slides along the slide groove. The slide fit may include a slide rail, and a hook provided at an end of the slide rail, and the slide groove may include a first groove configured to engage with the slide rail and an engagement groove provided at an end of the first groove and configured to engage with the hook.

The first coupling mechanism may include a female thread, and the second coupling mechanism may include a male thread configured to engage with the female thread to attach the third section of ice discharge duct to the second section of ice discharge duct. The first coupling mechanism may include a swing groove configured to guide the third section of ice discharge duct along a spiral path of a predetermined angle, and the second coupling mechanism may include a swing protrusion configured to engage with the swing groove such that the swing protrusion rotates spirally along the spiral path. The swing groove may include a spiral groove configured to receive the swing protrusion and guide the swing protrusion along the spiral path, and a stopper configured to engage with swing protrusion to attach the third section of ice discharge duct to the second section of ice discharge duct.

The tray may be adapted between the surface of the door and the door handle. At least a portion of the tray may be mounted to the door handle in a manner such that the portion of the tray may be removed from the door handle by lifting the tray in a vertical direction.

DETAILED DESCRIPTION

Figure 1:
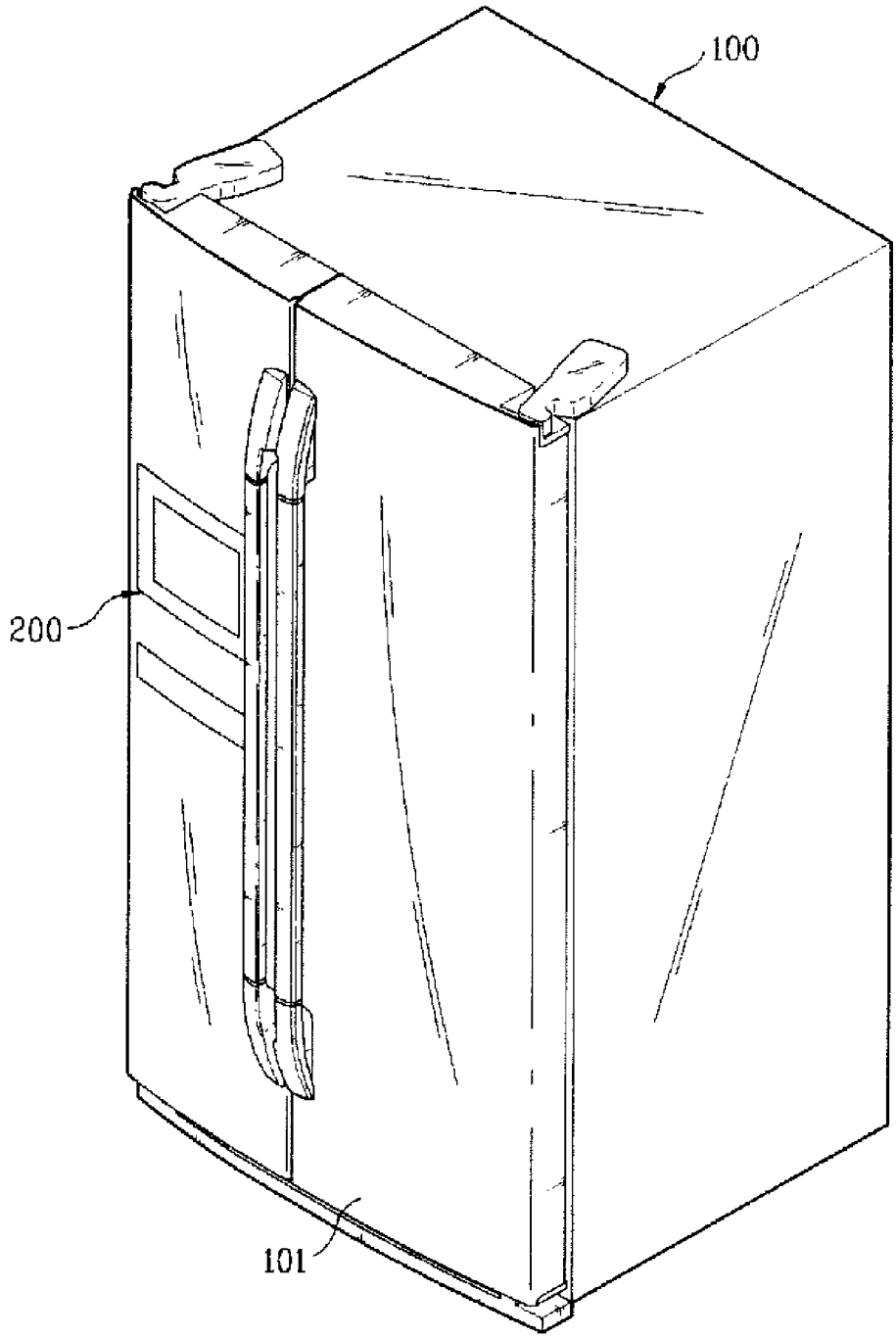
FIG. 1 is a view illustrating a refrigerator.

Referring to FIG. 1, a dispenser is installed at a front surface of a door of a refrigerator. The dispenser also may be provided as an independent appliance, may be positioned at a different portion of a refrigerator, or may be provided in another type of appliance. For example, the dispenser may be installed in the interior of the refrigerator. Also, the dispenser may be provided in various appliances, for example, a cooler, an ice dispenser, etc.

As shown in FIG. 1, the refrigerator includes a body 100 defining an outer appearance of the refrigerator, and at least one cooling compartment within the body 100. The refrigerator also includes a door 101 that opens or closes at least a portion of the cooling compartment. As shown, the refrigerator may include multiple doors that open and close the cooling compartment.

A dispenser 200 is installed at a door of the refrigerator. The dispenser 200 may include any kind of dispenser.

For example, the dispenser 200 may include a dispenser of a type in which the dispenser is embedded in the door of the refrigerator such that the dispenser is substantially flush with the door, and is tilted out upon being pressed by the user, as shown in FIGS. 2 to 6.

The dispenser 200 may also include a dispenser of a type in which the dispenser is embedded in the door of the refrigerator such that a certain space is formed inside the door (e.g., a dispensing cavity). The space (e.g., the dispensing cavity) enables the user to take out a content through the dispenser.

Also, the dispenser 200 may include a dispenser of a type in which the dispenser attached to a front surface of the door of the refrigerator and an outlet of the dispenser remains outside of the front surface of the door.

The dispenser may include dispensers of types other than the above-described types.

Figure 2:
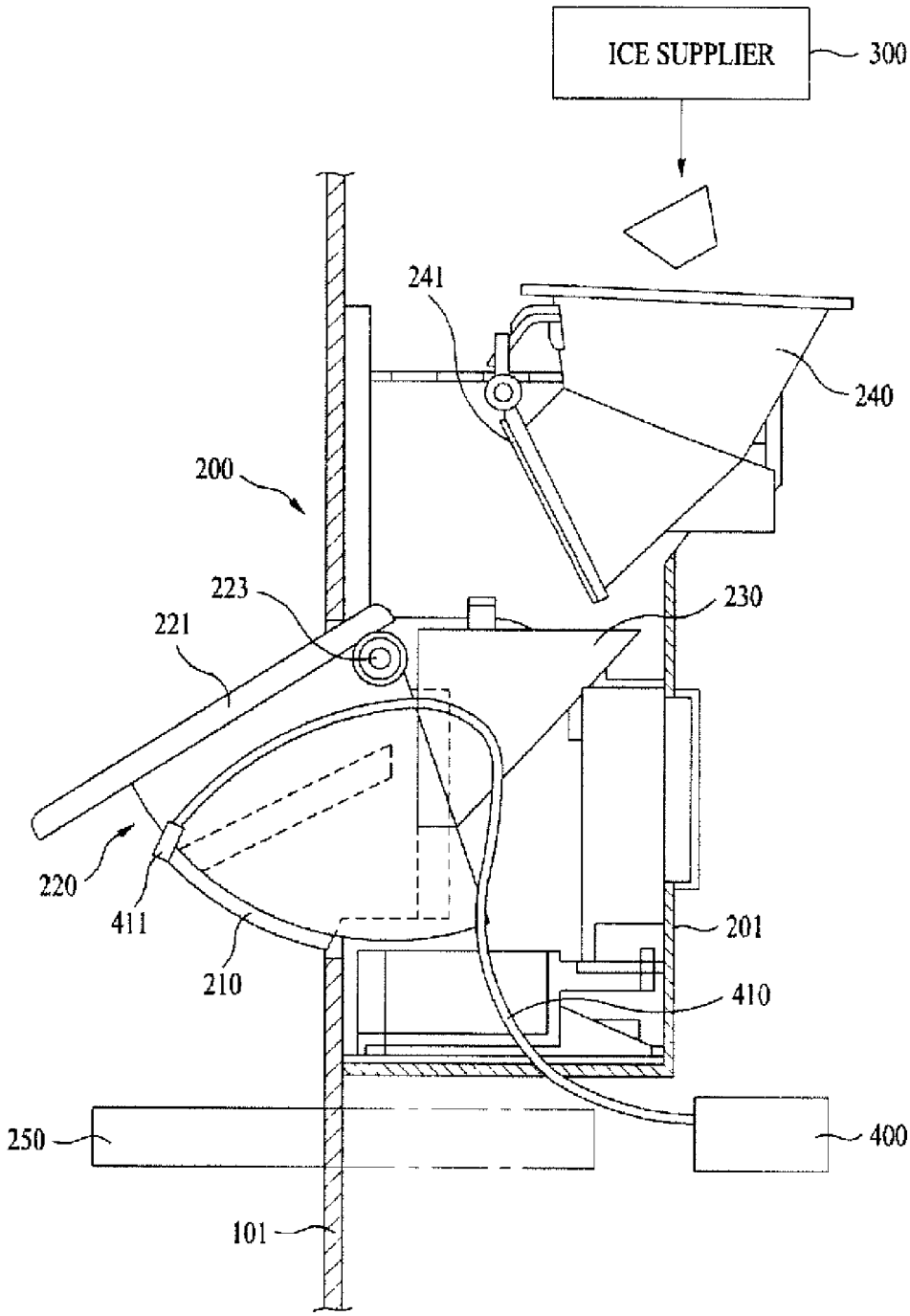
FIG. 2 is a lateral sectional view illustrating a dispenser.

FIG. 2 illustrates a dispenser. The dispenser illustrated in FIG. 2 is of the type in which the dispenser is embedded in a door of a refrigerator such that the dispenser is substantially flush with the door, and is tilted out upon being pressed by the user. This dispenser includes a body 201 and a guide member 210.

The body 201 is embedded in a refrigerator door 101 such that it may be tilted in or out between a stored position and an operable position, respectively. The body 201 is defined with a passage for discharging a certain content (e.g., liquid water or ice).

The guide member 210 is mounted to the body 201 at the inside of the body 201, and is configured to guide the discharge of content.

As shown in FIG. 2, a content supplier is arranged at the inside of the door 101 or in the cooling compartment, to supply the content.

In FIG. 2, the content supplier includes an ice supplier 300 for supplying ice, and a water tank 400 for supplying water. The content supplier may also dispense various drinking contents such as drinking water, slush, and other types of beverages.

Ice supplied from the ice supplier 300 is guided to the body 201 via a discharger. Water supplied from the water tank 400 is supplied via a water supply tube 410.

The discharger includes a discharging member 240 that guides movement of ice, and an opening/closing member 241 for opening or closing an open end of the discharging member 240, to allow the discharging member 240 to selectively discharge the ice.

The water supply tube 410 is connected, at one end thereof, to the water tank 400, and is fixed to one side of the guide member 210. The water supply tube 410 is provided, at the other end thereof, with a nozzle 411, to supply water through the nozzle 411.

The body 201 includes a moving body 220 configured to rotate about a rotating shaft 223 between a tilted-in state (e.g., a stored position) and a tilted-out state (e.g., an operable position). A front panel 221 is provided at a front side of the moving body 220. The front panel 221 provides a user interface enabling the user to input a command or to adjust the condition of the dispenser.

Figure 3:
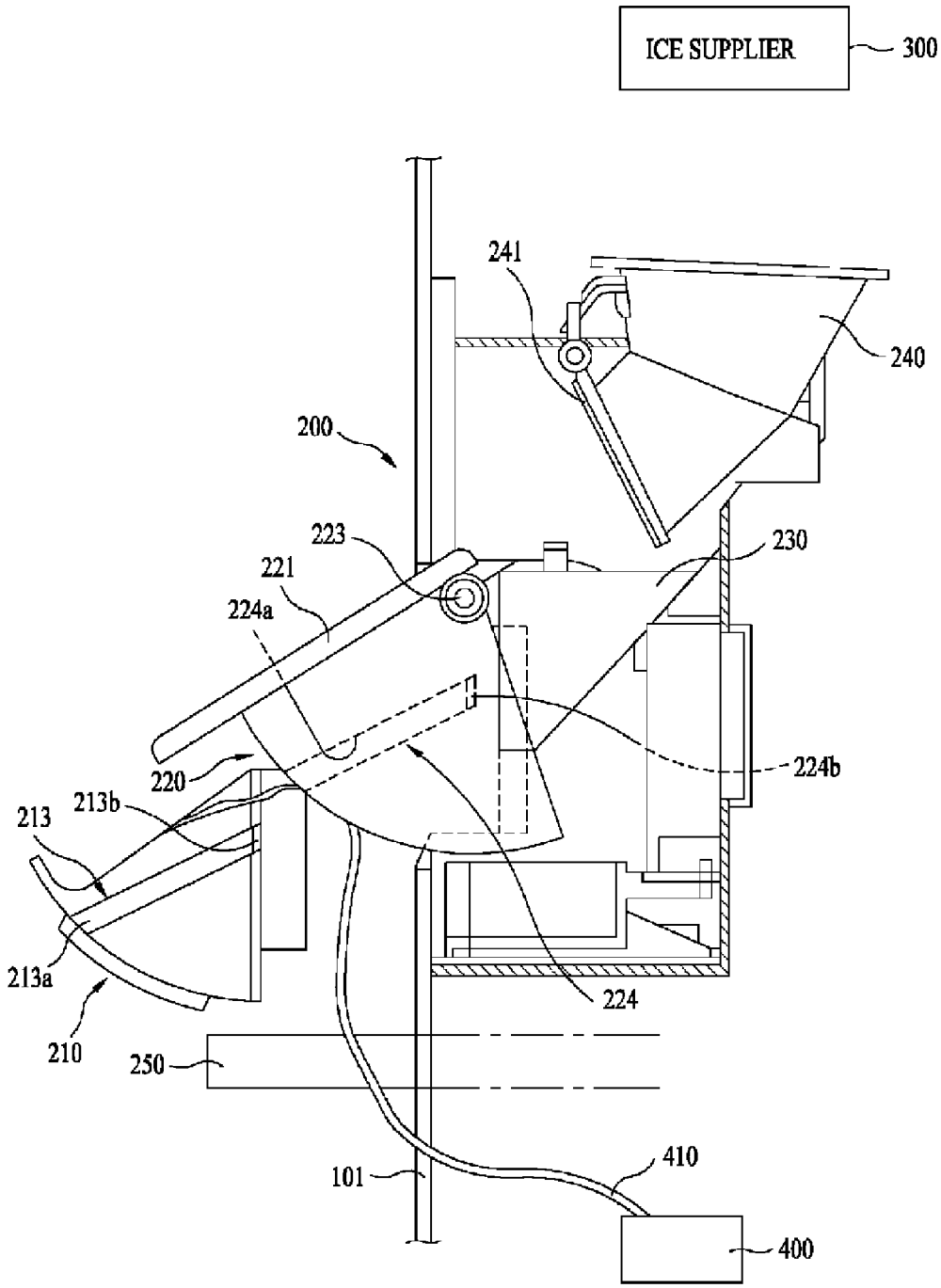
FIG. 3 is a view illustrating a separated state of a guide member included in the dispenser shown in FIG. 2.

As shown in FIGS. 2 and 3, the moving body 220 is separably coupled with the guide member 210. That is, the guide member 210 may be separated from the moving body 220 in the tilted-out state of the moving body 220.

Figure 4:
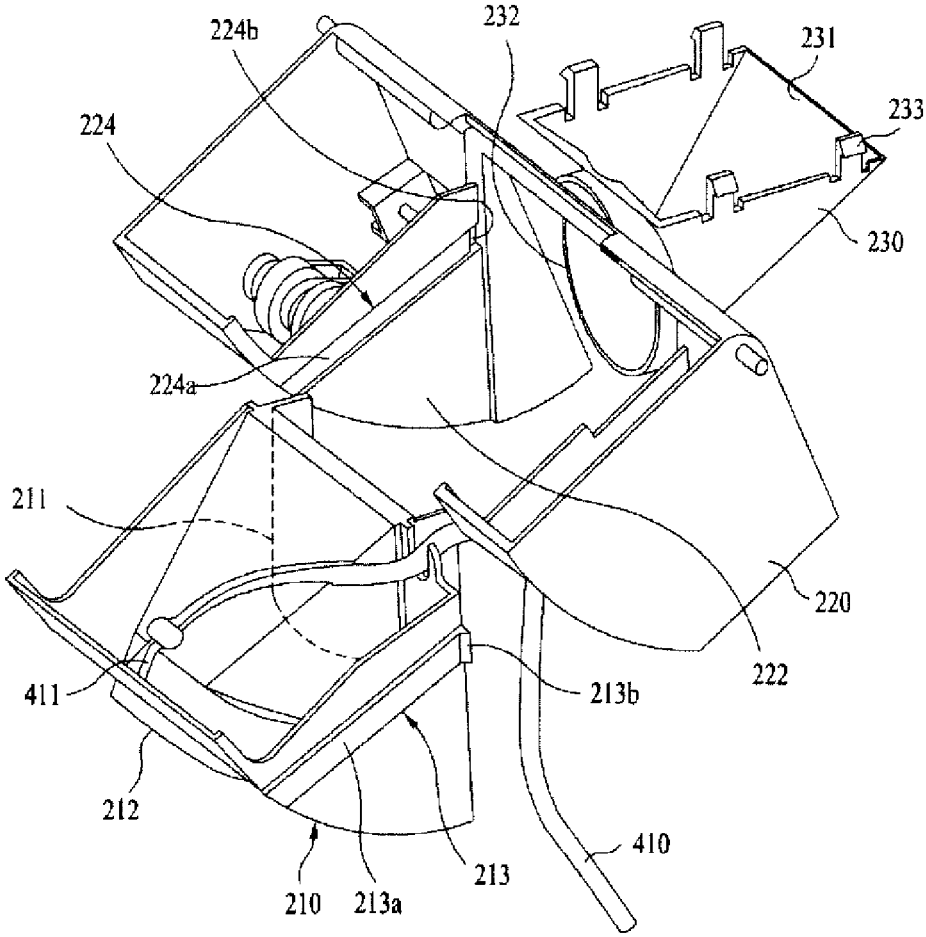
FIG. 4 is a perspective view of the dispenser shown in FIGS. 2 and 3.

FIGS. 3 and 4 show the separation of the guide member 210 in the tilted-out state of the moving body 220. The guide member 210 may be easily coupled to and separated from the body 201, as shown in FIGS. 3 and 4.

As shown in FIG. 4, the moving body 220 includes a seat 222, to seat the guide member 210 in the seat 222. The seat 222 and guide member 210 have couplings, respectively.

That is, one of the guide member 210 and seat 222 has a first coupling, whereas the other of the guide member 210 and seat 222 has a second coupling which is coupled with the first coupling to couple the guide member 210 to the seat 222.

In FIGS. 2 to 4, slide fits 213 are illustrated as an example of the first coupling, and slide grooves 224 are illustrated as an example of the second coupling.

As shown in FIGS. 3 and 4, each slide fit 213 includes a slide rail 213*a* and a hook 213*b*. Each slide groove 224 includes a groove 224*a* engaging with the associated slide rail 213*a*, to guide the sliding of the slide fit 213, and an engagement groove 224*b* engaging with the associated hook 213*b*, to couple the guide member 210 to the seat 222.

Thus, the guide member 210 may be easily coupled to and separated from the seat 222 of the moving body 220 by the slide fits 213 and slide grooves 224. Accordingly, a user may clean the dispenser after separating the guide member 210 from the seat 222. In this example, access to the interior of the body and the visibility of the interior of the body may be improved, so that a user's ability to clean the dispenser is improved.

Meanwhile, as shown in FIG. 4, the guide member 210 also has an inlet 211 configured to receive ice, and an outlet 212 configured to discharge ice received through the inlet 211.

A fixed guide 230 is arranged between the inlet 211 of the guide member 210 and the opening/closing member ("241" in FIG. 3) of the discharger, to guide ice supplied through the discharger ("240" in FIG. 3) toward the inlet 211 of the guide member 210.

The fixed guide 230 is provided, at an upper end thereof, with an opening 231. A connector 232 is provided at one side of the fixed guide 230. In accordance with this structure, ice supplied through the discharger ("240" in FIG. 3) is introduced into the fixed guide 230 through the opening 231, and is discharged from the fixed guide 230 through the connector 232. Thus, the ice is supplied to the inlet 211 of the guide member 210 via the fixed guide 230.

A plurality of fixing members 233 may be provided at the fixed guide 230 around the opening 231. The fixing members 233 are coupled to the body ("201" in FIG. 3) at certain positions within the body 201 to attach the fixed guide 230 to the body 201.

As shown in FIGS. 2 and 3, an actuator 250 is arranged at a lower portion of the body 201. The actuator 250 is operated by the user, to enable the dispenser to dispense a certain content (e.g., liquid water or ice).

The actuator 250 may have various structures. As shown in FIGS. 2 and 3, the dispenser includes a button tray as an example of the actuator 250.

The button tray performs two functions, namely, a function to receive a residue discharged through the guide member 210 after the dispensing of the content, and a function to actuate the dispense.

For example, when the user tilts out the moving body 220, the button tray is moved simultaneously with the tilt-out of the moving body 220. When the user pushes the button tray by a certain distance, using, for example, a cup held by the user, ice or water is discharged into the cup through the guide member 210.

If the user determines that the content is sufficiently filled in the cup, the user releases the cup from the button tray (e.g., releases the pushing force applied to the button tray). Releasing the force applied to the button tray causes the button tray to move to a position aligned with an outlet of the guide member 210. In this position, a residue discharged through the guide member 210 is captured and stored into the button tray 250.

Figure 5:
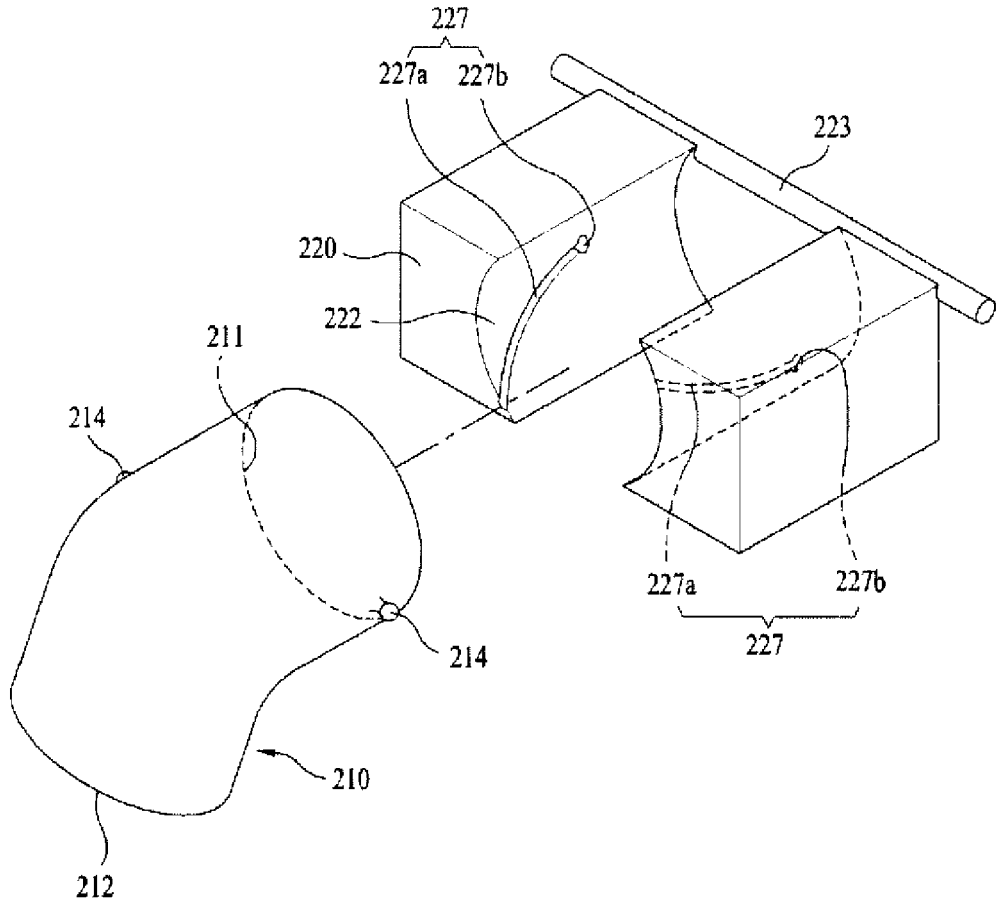
FIG. 5 is a perspective view illustrating a separated state of a guide member included in a dispenser.

FIG. 5 illustrates a separated state of a guide member included in a dispenser. The dispenser shown in FIG. 5 is different from the dispenser shown in FIG. 4, in terms of the coupling structure of the guide member 210 and seat 222.

As shown in FIG. 5, the guide member 210 has swing protrusions 214 as the first coupling, and the seat 222 has swing grooves 227 as the second coupling.

Each swing protrusion 214 engages with the associated swing groove 227 such that the swing protrusion 214 slides along the swing groove 227. In accordance with the sliding of the swing protrusions 214, the guide member 210 rotates by a certain angle, to be seated in the seat 222.

Each swing groove 227 includes a spiral groove 227*a*, and a stopper 227*b* positioned at an inner end of the spiral groove 227*a*.

The swing grooves 227 are located at opposite inner surfaces of the seat 222, respectively. The swing groove 227 located at one inner surface of the seat 222 extends spirally in an upward direction, whereas the swing groove 227 located at the other inner surface of the seat 222 extends spirally in a downward direction.

Accordingly, when the swing protrusions engage with the spiral grooves 227*a* formed at the opposite inner surfaces of the seat 222, and slide spirally along the spiral grooves 227*a*, the guide member 210 rotates by a certain angle, and is then seated in the seat 222.

As each swing protrusion 214 slides along the associated spiral groove 227*a*, it reaches the associated stopper 227*b*, and comes into contact with the stopper 227*b*. As the swing protrusion 214 further slides against the resistance of the stopper 227*b*, it moves over the stopper 227, so that it is engaged between the end of the spiral groove 227*a* and the stopper 227*b*. As a result, the rotation of the guide member 210 is stopped and the guide member 210 is seated in the seat 222.

In this example, the positions of the swing protrusions 214 and the lengths of the spiral grooves 227*a* may be appropriately determined such that the inlet 211 and outlet 212 of the guide member 210 are directed in desired directions, respectively.

That is, although the guide member 210 rotates by a certain angle after being fitted in the seat 222 in an inclined state, it is arranged in a dispensing position configured to guide content being dispensed after being completely seated in the seat 222.

Figure 6:
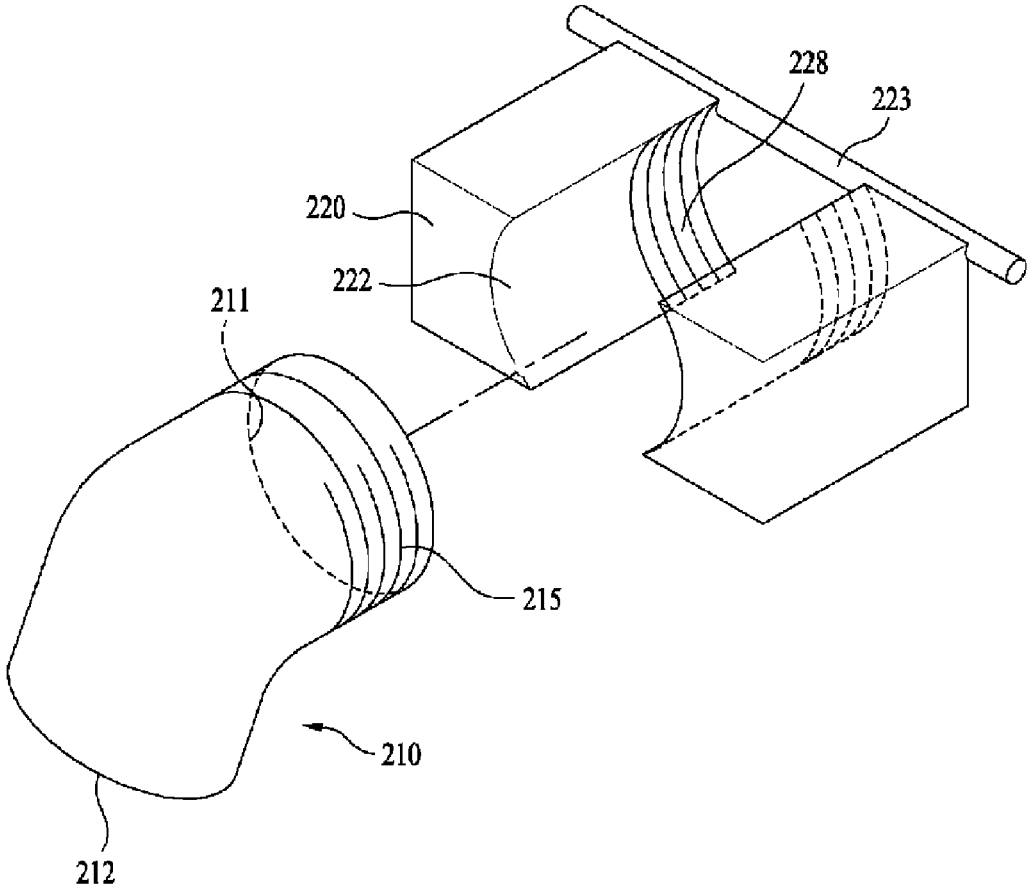
FIG. 6 is a perspective view illustrating a separated state of a guide member included in a dispenser.

FIG. 6 illustrates a separated state of a guide member included in a dispenser. The dispenser shown in FIG. 6 is different from of the dispensers shown in FIGS. 4 and 5, in terms of the coupling structure of the guide member 210 and seat 222.

In the dispenser shown in FIG. 6, the guide member 210 has a male thread 215 as the first coupling, and the seat 222 has a female thread 228 as the second coupling.

The seating of the guide member 210 in the seat 222 is achieved by fitting the guide member 210 into the seat 222 such that the male thread 215 engages with the female thread 228, and then rotating the guide member 210 by a certain angle.

In this example, positions and lengths of the male thread 215 and female thread 228 may be appropriately determined such that the inlet 211 and outlet 212 of the guide member 210 are arranged in position.

Figure 7:
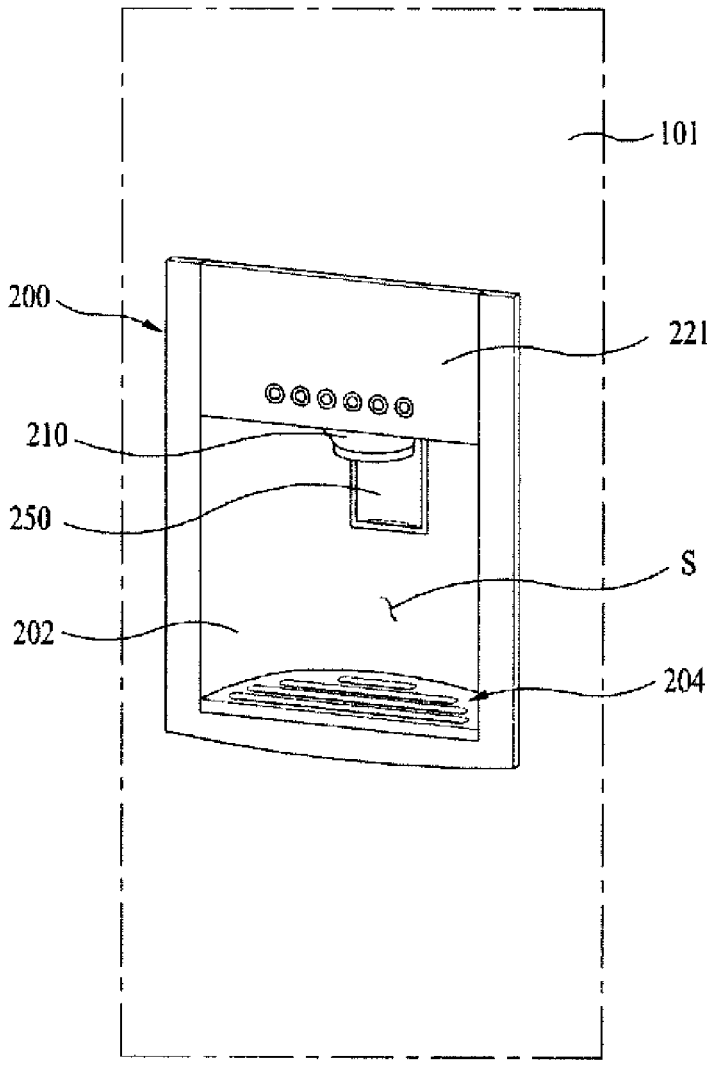
FIG. 7 is a view illustrating a dispenser.

FIG. 7 illustrates a dispenser. The dispenser 200 shown in FIG. 7 is installed at a refrigerator door 101 in an embedded state, and defines a certain space or dispensing cavity S to allow a user to receive content form the dispenser 200.

A front panel 221 is arranged on the front side of the dispenser 200 at an upper portion of the dispenser 200, to provide a user interface. A space S is defined beneath the front panel 221, to allow the user to position a cup or the like on the bottom of the space S beneath an outlet of the dispenser 200.

A rear wall 202 is arranged at the rear side of the space S, to partition the interior of the dispenser 200 into an inner portion and an outer portion. A bottom wall 204 is arranged at a lower end of the dispenser 200. The bottom wall 204 may be a tray configured to receive a residue discharged from the dispenser.

A button or a lever may be mounted at one side of the rear wall 202, as an actuator 250. The actuator 250 functions to control the discharge of the content through the guide member 210.

Figure 8:
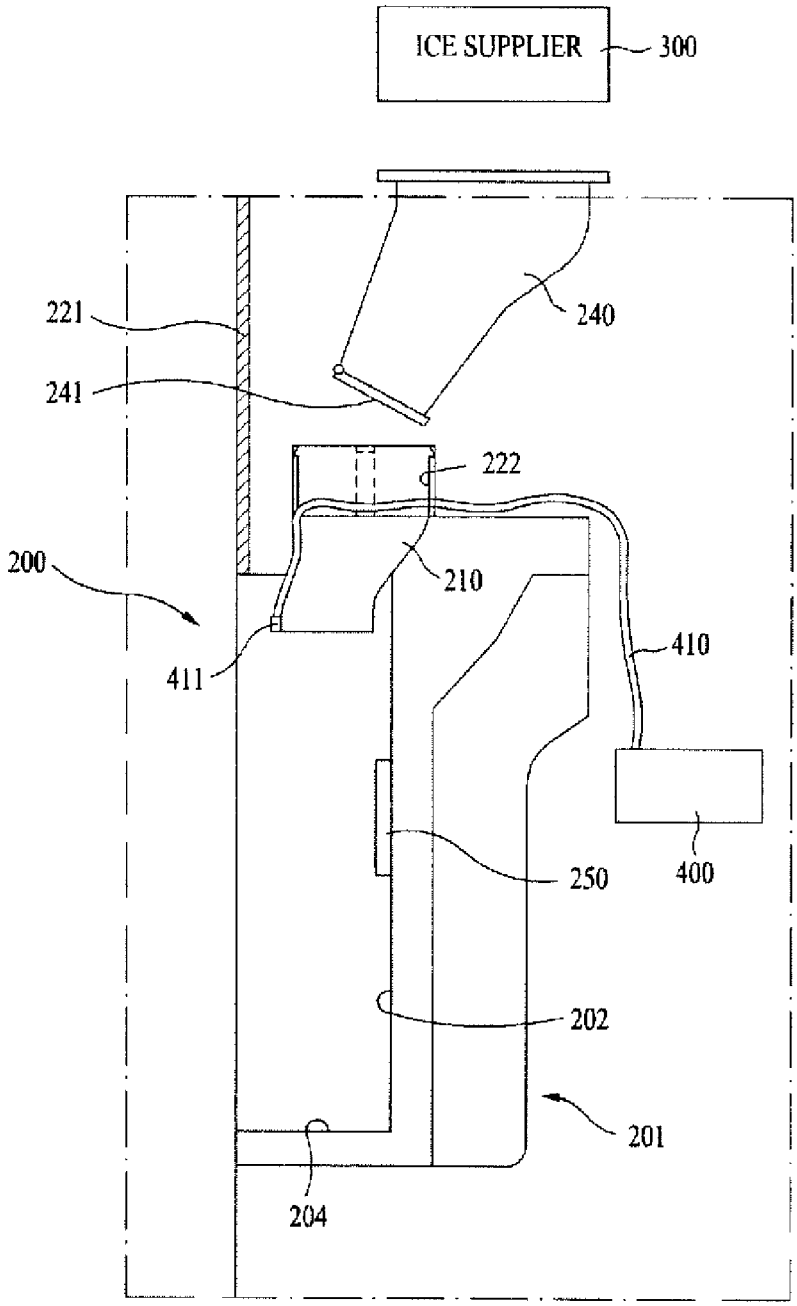
FIG. 8 is a lateral sectional view of the dispenser shown in FIG. 7.
Figure 9:
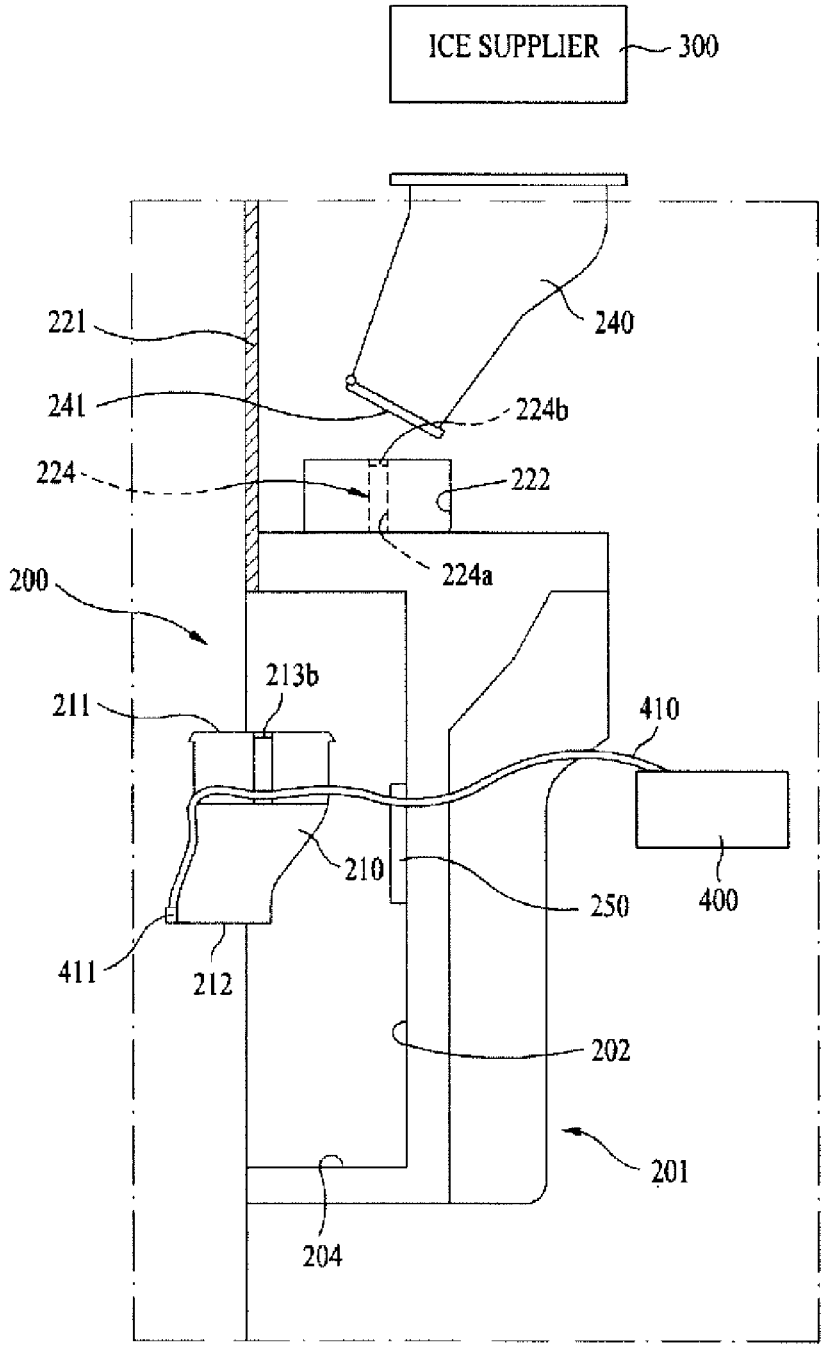
FIG. 9 is a view illustrating a separated state of a guide member included in the dispenser shown in FIG. 8.

FIG. 8 illustrates the dispenser shown in FIG. 7 and FIG. 9 illustrates a separated state of a guide member included in the dispenser shown in FIG. 8. The dispenser shown in FIGS. 8 and 9 includes a body 201 and a guide member 210.

The body 201 is embedded in a refrigerator door 101, and has a space or dispensing cavity defined by the rear wall 202 and bottom wall 204.

The guide member 210 is mounted in the interior of the body 201, and configured to guide content to dispensed from the dispenser 200.

As shown in FIGS. 8 and 9, a content supplier is arranged at the inside of the door 101 or in the cooling compartment, and configured to supply the content (e.g., water or ice).

In the example illustrated in FIGS. 8 and 9, the content supplier includes an ice supplier 300 for supplying ice, and a water tank 400 for supplying water. In addition to ice, the content supplier may also dispense various drinking contents such as drinking water, slush, and other types of beverages.

Ice supplied from the ice supplier 300 is guided to the body 201 via a discharger. Water supplied from the water tank 400 is supplied via a water supply tube 410.

The discharger includes a discharging member 240 for guiding the movement of ice, and an opening/closing member 241 for opening or closing an open end of the discharging member 240, to allow the discharging member 240 to selectively discharge ice.

The water supply tube 410 is connected, at one end thereof, to the water tank 400, and is fixed to one side of the guide member 210. The water supply tube 410 is provided, at the other end thereof, with a nozzle 411, and is configured to supply water through the nozzle 411.

The guide member 210 may be separable from the body 201. That is, as shown in FIGS. 8 and 9, the guide member 210 may be easily coupled to and separated from the body 201.

As shown in FIGS. 8 and 9, the body 201 includes a seat 222 that seats the guide member 210 in the seat 222. The seat 222 and guide member 210 have couplings, respectively.

The body 201 may be coupled to the door 101 by a coupling protrusion 201 a provided at one of the second section of ice discharge duct and the door 101 and a coupling groove 201*b* provided at the other of the second section of ice discharge duct and the door 101, the coupling groove being configured to engage with the coupling protrusion. In the embodiment illustrated in FIG. 12, the coupling protrusion 201*a* is provided at the body 201 and the coupling groove 201*b* is provided at the door 101.

That is, one of the guide member 210 and seat 222 has a first coupling, whereas the other of the guide member 210 and seat 222 has a second coupling which is coupled with the first coupling to couple the guide member 210 to the seat 222.

In FIG. 9, slide fits 213 are illustrated as an example of the first coupling, and slide grooves 224 are illustrated as an example of the second coupling.

Each slide fit 213 includes a slide rail 213*a*, and a hook 213*b*. On the other hand, each slide groove 224 includes a groove 224*a* engaging with the associated slide rail 213*a*, to guide the slide rail 213*a*, and an engagement groove 224*b* that engages with the associated hook 213*b*, to couple the guide member 210 to the seat 222.

Thus, the guide member 210 may be easily coupled to and separated from the seat 222 of the body 201 by the slide fits 213 and slide grooves 224. Accordingly, a user may clean the dispenser after separating the guide member 210 from the seat 222. In this example, access to the interior of the body and the visibility of the interior of the body may be improved, so that a user's ability to clean the dispenser may be improved.

The guide member 210 also has an inlet 211 for receiving ice, and an outlet 212 for discharging ice received through the inlet 211. Accordingly, ice supplied through the discharging member 240 is guided to the inlet 211 of the guide member 210, and is then outwardly discharged through the outlet 212.

The first and second couplings also may be configured using swing protrusions and swing grooves, or a male thread and a female thread.

The configuration of the swing protrusions and swing grooves and the configuration of the male thread and female thread has been described above with reference to FIGS. 5 and 6. Configurations similar to those described above may be used in the dispenser 200 described with respect to FIGS. 7-9.

Figure 10:
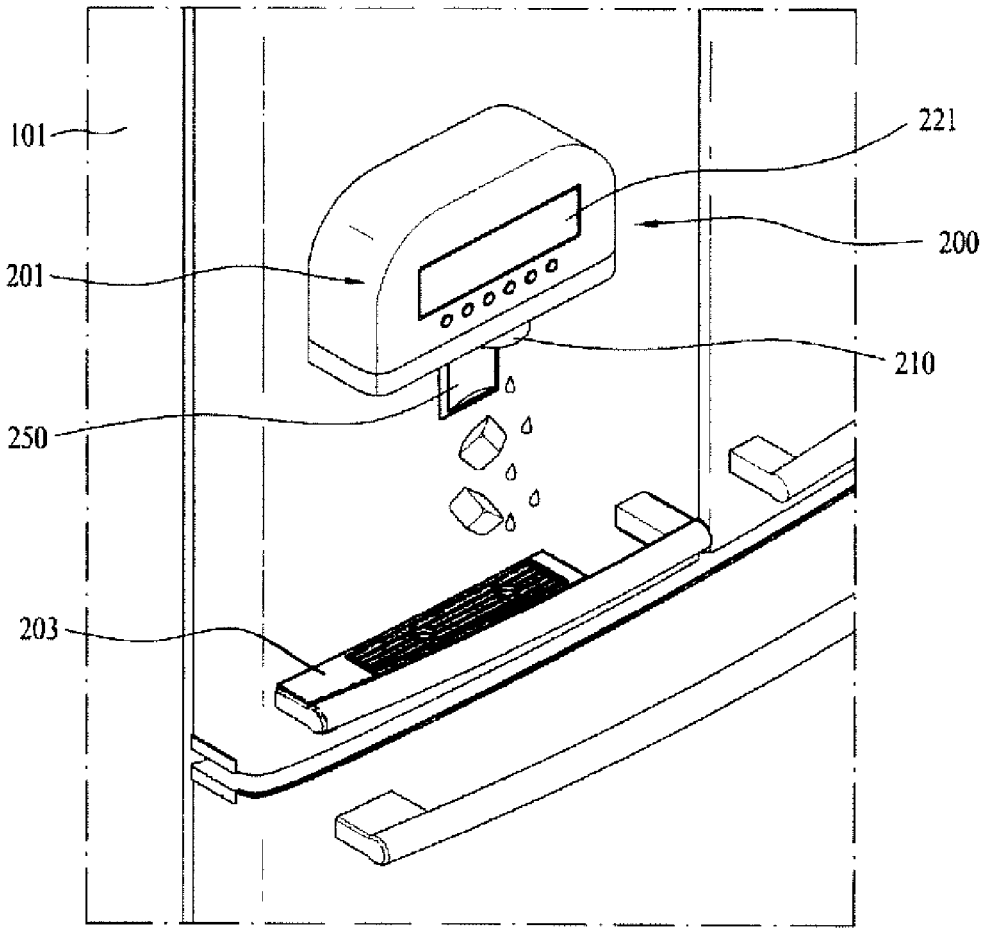
FIG. 10 is a view illustrating a dispenser.

FIG. 10 illustrates a dispenser. The dispenser 200 shown in FIG. 10 is installed at a refrigerator door 101 in a position in which an outlet of the dispenser 200 remains outside of a front surface of the refrigerator door 101.

That is, the dispenser includes a body 201 installed at the refrigerator door such that it is positioned outside of the refrigerator door by a certain length. A front panel 221 is arranged on the front side of the dispenser 200, to provide a user interface. The body 201 has an open end to allow the content to be outwardly discharged through the guide member 210.

A tray 203 is arranged at a position spaced apart from the lower end of the body 201 and secured by a handle of the refrigerator door 101. The tray 203 is configured to receive a residue outwardly discharged through the guide member 210.

A button or a lever is arranged between the body 201 and the tray 203, as an actuator 250. The actuator 250 may be a lever rotatably mounted to the body 201, or may be a button.

Figure 11:
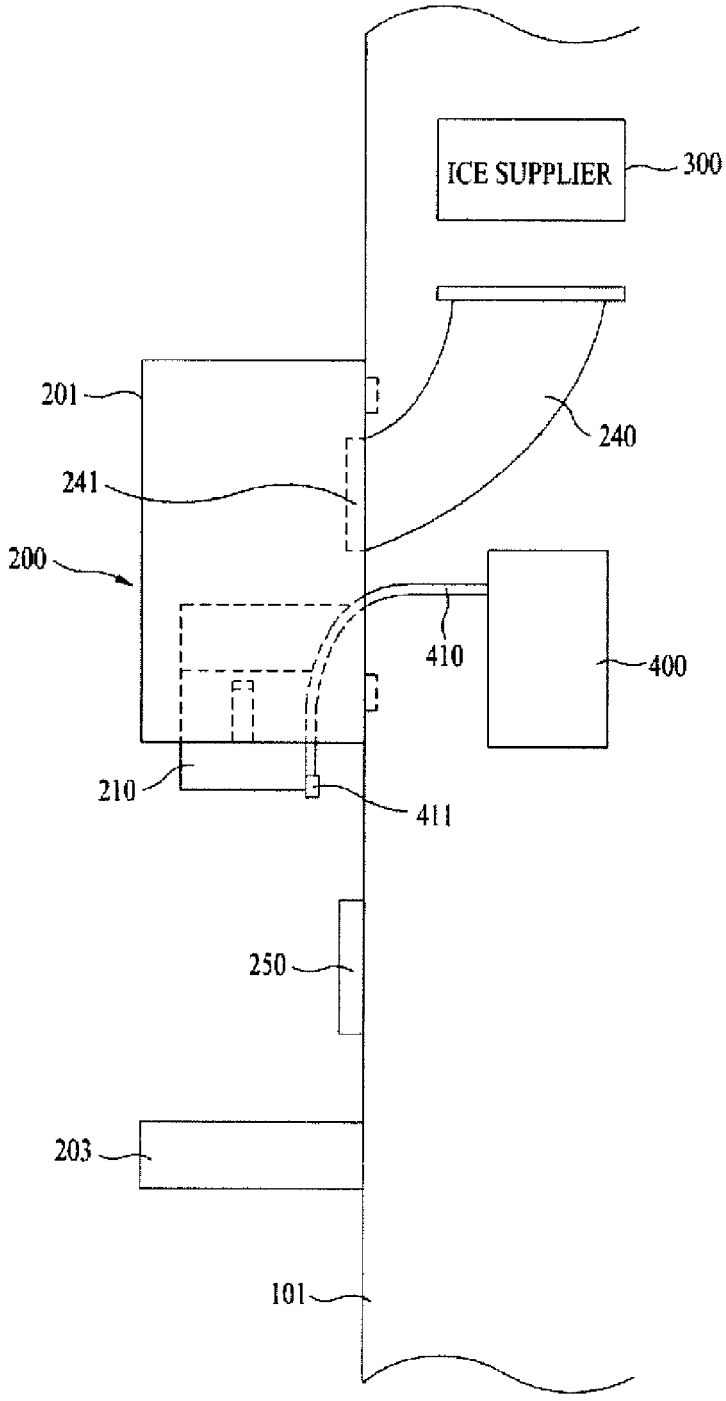
FIG. 11 is a lateral sectional view of the dispenser shown in FIG. 10.
Figure 12:
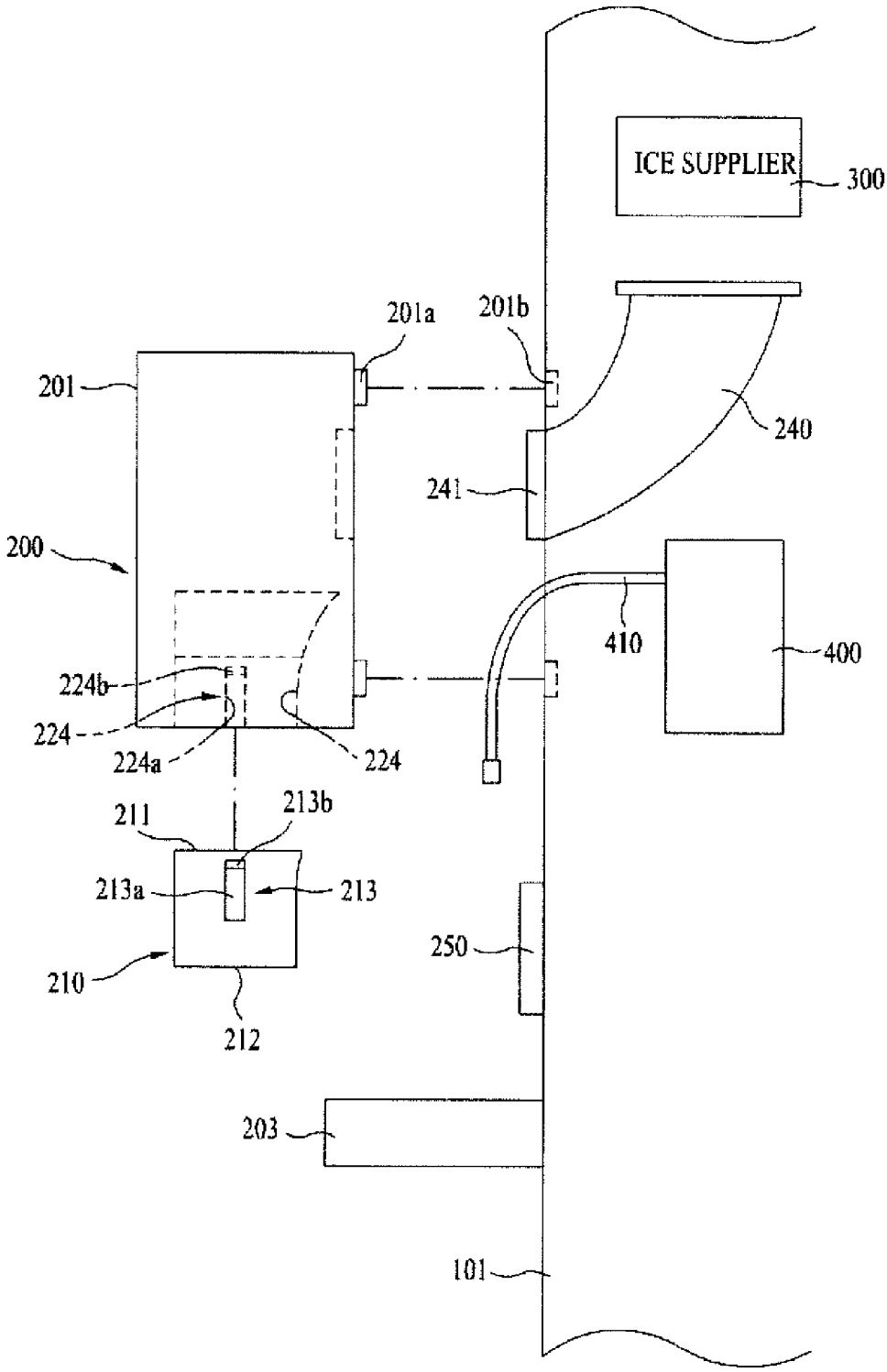
FIG. 12 is a view illustrating a separated state of a guide member included in the dispenser shown in FIG. 11.

FIG. 11 illustrates the dispenser shown in FIG. 10 and FIG. 12 illustrates a separated state of a guide member included in the dispenser shown in FIG. 11. The dispenser according to the embodiment illustrated in FIGS. 11 and 12 includes a body 201 and a guide member 210.

The body 201 is installed at a refrigerator door 101 such that it is forwardly protruded from the door 101 by a certain length.

The guide member 210 is mounted in the interior of the body 201, and configured to guide the content to be outwardly discharged.

As shown in FIGS. 11 and 12, a content supplier is arranged at the inside of the door 101 or in the cooling compartment, and configured to supply content.

In the example illustrated in FIGS. 11 and 12, the content supplier includes an ice supplier 300 for supplying ice, and a water tank 400 for supplying water. In addition to ice, the content supplier may also dispense various drinking contents such as drinking water, slush, and other types of beverages.

Ice supplied from the ice supplier 300 is guided to the body 201 via a discharger. Water supplied from the water tank 400 is supplied via a water supply tube 410.

The discharger includes a discharging member 240 for guiding the movement of ice, and an opening/closing member 241 for opening or closing an open end of the discharging member 240, to allow the discharging member 240 to selectively discharge the ice.

The water supply tube 410 is connected, at one end thereof, to the water tank 400, and is fixed to one side of the guide member 210. The water supply tube 410 is provided, at the other end thereof, with a nozzle 411, to supply water through the nozzle 411.

The guide member 210 may be separable from the body 201. That is, as shown in FIGS. 11 and 12, the guide member 210 may be easily coupled to and separated from the body 201.

As shown in FIGS. 11 and 12, the body 201 includes a seat 222, to seat the guide member 210 in the seat 222. The seat 222 and guide member 210 have couplings, respectively.

That is, one of the guide member 210 and seat 222 has a first coupling, whereas the other of the guide member 210 and seat 222 has a second coupling which is coupled with the first coupling to couple the guide member 210 to the seat 222.

In FIGS. 11 and 12, slide fits 213 are illustrated as an example of the first coupling, and slide grooves 224 are illustrated as an example of the second coupling.

Each slide fit 213 includes a slide rail 213*a* and a hook 213*b*. Each slide groove 224 includes a groove 224*a* engaging with the associated slide rail 213*a*, to guide the slide rail 213*a*, and an engagement groove 224*b* engaging with the associated hook 213*b*, to couple the guide member 210 to the seat 222.

Thus, the guide member 210 may be easily coupled to and separated from the seat 222 of the body 201 by the slide fits 213 and slide grooves 224. Accordingly, a user may clean the dispenser after separating the guide member 210 from the seat 222. In this example, access to the interior of the body and the visibility of the interior of the body may be improved, so that a user's ability to clean the dispenser may be improved.

The guide member 210 also has an inlet 211 for receiving ice, and an outlet 212 for discharging ice received through the inlet 211. Accordingly, ice supplied through the discharging member 240 is guided to the inlet 211 of the guide member 210, and is then outwardly discharged through the outlet 212.

The first and second couplings also may be configured using swing protrusions and swing grooves, or a male thread and a female thread.

The configuration of the swing protrusions and swing grooves and the configuration of the male thread and female thread has been described above with reference to FIGS. 5 and 6. Configurations similar to those described above may be used in the dispenser 200 described with respect to FIGS. 10-12.

As apparent from the above description, in a refrigerator including a dispenser, a guide member may be easily coupled to and separated from a body of the dispenser. Accordingly, access to the interior of the body and visibility of the interior of the body may be improved, so that the dispenser may be easily cleaned.

A dispenser capable of securing a desired visibility of the interior thereof and an easy access to the interior thereof maybe provided, and easy cleaning of the interior thereof may be achieved.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator dispenser comprising:

a first section of ice discharge duct that defines a first portion of an ice flow passage configured to receive ice supplied from an ice supplier and guide the ice, at least a portion of the first section of ice discharge duct being positioned behind a surface of a door of a refrigerator;

a second section of ice discharge duct that is configured to receive the ice guided by the first portion of the ice flow passage defined by the first section of ice discharge duct and further guide the ice along a second portion of the ice flow passage, at least a portion of the second section of ice discharge duct being positioned in front of the surface of the door of the refrigerator;

a third section of ice discharge duct that is configured to receive the ice guided by the second portion of the ice flow passage defined by the second section of ice discharge duct and further guide the ice along a third portion of the ice flow passage through an outlet of the third section of ice discharge duct that is positioned in front of the surface of the door of the refrigerator and configured to guide the ice to a position outside of the ice flow passage in front of the surface of the door of the refrigerator; and a first coupling mechanism located at the second section of ice discharge duct and a second coupling mechanism located at the third section of ice discharge duct, the first and second coupling mechanisms being configured to engage and disengage with each other to enable removal of the third section of ice discharge duct from the second section of ice discharge duct and attachment of the third section of ice discharge duct to the second section of ice discharge duct.

2. The dispenser according to claim 1, further comprising a button and tray combination device that is configured to control the dispenser to dispense ice through the outlet of the third section of ice discharge duct and that is configured to receive and store residual content discharged from the outlet of the third section of ice discharge duct after a container used in actuating the button and tray combination device is moved from beneath the outlet of the third section of ice discharge duct.

3. The dispenser according to claim 1, further comprising:

a door handle provided below the outlet of the third section of ice discharge duct; and a tray secured to the door handle and positioned to receive ice dispensed from the outlet of the third section of ice discharge duct.

4. The dispenser according to claim 1, wherein the first section of ice discharge duct is embedded in a refrigerator door and the second section of ice discharge duct is configured to move from a stored position in which an outlet of the second section of ice discharge duct is positioned behind a surface of the refrigerator door to an operable position in which the outlet of the second section of ice discharge duct is positioned in front of the surface of the refrigerator door.

5. The dispenser according to claim 4, further comprising:

a fixed guide that is attached to the first section of ice discharge duct, positioned within the first section of ice discharge duct, and configured to guide the content to the second section of ice discharge duct.

6. The dispenser according to claim 5, wherein the second section of ice discharge duct comprises a moving body rotatable or slidable with respect to the refrigerator door such that the moving body is configured move from a stored position in which a portion of the moving body is positioned behind the surface of the refrigerator door to an operable position in which the portion of the moving body is positioned in front of the surface of the refrigerator door, the moving body including a seat configured to receive the third section of ice discharge duct when the third section of ice discharge duct is attached to the second section of ice discharge duct.

7. The dispenser according to claim 6, further comprising:

a discharger arranged between the fixed guide and the supplier, the discharger including a member configured to open and close the discharger to selectively supply content from the supplier to the fixed guide.

8. The dispenser according to claim 1, wherein the first section of ice discharge duct is embedded in a refrigerator door, the dispenser defines, in front of the surface of the refrigerator door, a dispensing area configured to receive a container, and the first section of ice discharge duct, the second section of ice discharge duct, and the third section of the ice discharge duct are configured to guide content to the dispensing area.

9. The dispenser according to claim 8, wherein the second section of ice discharge duct includes a seat configured to receive the third section of ice discharge duct when the third section of ice discharge duct is attached to the second section of ice discharge duct.

10. The dispenser according to claim 9, further comprising:

a discharger arranged between the second section of ice discharge duct and the supplier, the discharger including a member configured to open and close the discharger to selectively supply content from the supplier to the second section of ice discharge duct.

11. The dispenser according to claim 1, wherein the second section of ice discharge duct is coupled to a surface of the door of the refrigerator such that the second section of ice discharge duct is positioned outside of the surface of the door on a side opposite of a compartment opened and closed by the door.

12. The dispenser according to claim 11, wherein the second section of ice discharge duct includes a seat configured to receive the third section of ice discharge duct when the third section of ice discharge duct is attached to the second section of ice discharge duct.

13. The dispenser according to claim 1, wherein:

the first coupling mechanism comprises a slide groove; and the second coupling mechanism comprises a slide fit that is configured to engage with the slide groove such that the slide fit slides along the slide groove.

14. The dispenser according to claim 13, wherein:

the slide fit comprises a slide rail, and a hook provided at an end of the slide rail; and the slide groove comprises a first groove configured to engage with the slide rail and an engagement groove provided at an end of the first groove and configured to engage with the hook.

15. The dispenser according to claim 1, wherein:

the first coupling mechanism comprises a female thread; and the second coupling mechanism comprises a male thread configured to engage with the female thread to attach the third section of ice discharge duct to the second section of ice discharge duct.

16. The dispenser according to claim 1, wherein:

the first coupling mechanism comprises a swing groove configured to guide the third section of ice discharge duct along a spiral path of a predetermined angle; and the second coupling mechanism comprises a swing protrusion configured to engage with the swing groove such that the swing protrusion rotates spirally along the spiral path.

17. The dispenser according to claim 16, wherein the swing groove comprises:

a spiral groove configured to receive the swing protrusion and guide the swing protrusion along the spiral path; and a stopper configured to engage with swing protrusion to attach the third section of ice discharge duct to the second section of ice discharge duct.

18. The dispenser according to claim 1, further comprising:

a coupling protrusion provided at one of the second section of ice discharge duct and the door; and a coupling groove provided at the other of the second section of ice discharge duct and the door, the coupling groove being configured to engage with the coupling protrusion, wherein the second section of ice discharge duct is removable from and replaceable to the refrigerator door.

19. A refrigerator comprising:

a refrigerator body defining a cooling compartment;

a door configured to open and close at least a portion of the cooling compartment;

a first section of ice discharge duct that defines a first portion of an ice flow passage configured to receive ice supplied from an ice supplier and guide the ice, at least a portion of the first section of ice discharge duct being positioned behind a surface of the door;

a second section of ice discharge duct that is configured to receive the ice guided by the first portion of the ice flow passage defined by the first section of ice discharge duct and further guide the ice along a second portion of the ice flow passage, at least a portion of the second section of ice discharge duct being positioned in front of the surface of the door;

a third section of ice discharge duct that is configured to receive the ice guided by the second portion of the ice flow passage defined by the second section of ice discharge duct and further guide the ice along a third portion of the ice flow passage through an outlet of the third section of ice discharge duct that is positioned in front of the surface of the door and configured to guide the ice to a position outside of the ice flow passage in front of the surface of the door; and a first coupling mechanism located at the second section of ice discharge duct and a second coupling mechanism located at the third section of ice discharge duct, the first and second coupling mechanisms being configured to engage and disengage with each other to enable removal of the third section of ice discharge duct from the second section of ice discharge duct and attachment of the third section of ice discharge duct to the second section of ice discharge duct.

20. The refrigerator according to claim 19, wherein:

the first coupling mechanism comprises a slide groove;

the second coupling mechanism comprises a slide fit that is configured to engage with the slide groove such that the slide fit slides along the slide groove;

the slide fit comprises a slide rail, and a hook provided at an end of the slide rail; and the slide groove comprises a first groove configured to engage with the slide rail and an engagement groove provided at an end of the first groove and configured to engage with the hook.

21. The refrigerator according to claim 19, wherein:

the first coupling mechanism comprises a female thread; and the second coupling mechanism comprises a male thread configured to engage with the female thread to attach the third section of ice discharge duct to the second section of ice discharge duct.

22. The refrigerator according to claim 19, wherein:

the first coupling mechanism comprises a swing groove configured to guide the third section of ice discharge duct along a spiral path of a predetermined angle; and the second coupling mechanism comprises a swing protrusion configured to engage with the swing groove such that the swing protrusion rotates spirally along the spiral path, and the swing groove comprises:

a spiral groove configured to receive the swing protrusion and guide the swing protrusion along the spiral path; and a stopper configured to engage with swing protrusion to attach the third section of ice discharge duct to the second section of ice discharge duct.

23. The refrigerator according to claim 19, further comprising:

a door handle provided below the outlet of the third section of ice discharge duct; and a tray secured to the door handle and positioned to receive ice dispensed from the outlet of the third section of ice discharge duct, wherein the tray is secured between the surface of the door and the door handle.

24. The refrigerator according to claim 23, wherein at least a portion of the tray is mounted to the door handle in a manner such that the portion of the tray may be removed from the door handle by lifting the tray in a vertical direction.

* * * * *